US010208750B2

(12) United States Patent
Kawamura et al.

(10) Patent No.: US 10,208,750 B2
(45) Date of Patent: Feb. 19, 2019

(54) POSTURE CONTROL OF A BALANCE WEIGHT IN A SCROLL COMPRESSOR

(71) Applicant: MITSUBISHI ELECTRIC CORPORATION, Chiyoda-ku (JP)

(72) Inventors: Raito Kawamura, Chiyoda-ku (JP); Shin Sekiya, Chiyoda-ku (JP); Shinichi Wakamoto, Chiyoda-ku (JP); Mihoko Shimoji, Chiyoda-ku (JP); Hideaki Nagata, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 85 days.

(21) Appl. No.: 15/311,421

(22) PCT Filed: May 8, 2015

(86) PCT No.: PCT/JP2015/063365
§ 371 (c)(1),
(2) Date: Nov. 15, 2016

(87) PCT Pub. No.: WO2015/190195
PCT Pub. Date: Dec. 17, 2015

(65) Prior Publication Data

US 2017/0082109 A1 Mar. 23, 2017

(30) Foreign Application Priority Data

Jun. 11, 2014 (JP) ..... 2014-120549

(51) Int. Cl.
*F04C 18/02* (2006.01)
*F04C 23/00* (2006.01)
*F04C 29/00* (2006.01)

(52) U.S. Cl.
CPC ..... *F04C 18/0215* (2013.01); *F04C 23/008* (2013.01); *F04C 29/0057* (2013.01);
(Continued)

(58) Field of Classification Search
CPC ..... F04C 2240/807
See application file for complete search history.

(56) References Cited

U.S. PATENT DOCUMENTS 5,222,881 A * 6/1993 Sano ..... F04C 18/0215 384/192
5,582,513 A 12/1996 Shigeoka et al.
2012/0258003 A1 10/2012 Hahn

FOREIGN PATENT DOCUMENTS

CN 1113548 A 12/1995
JP 4-49602 U 4/1992
(Continued)

OTHER PUBLICATIONS

Extendnd European Search Report dated Jan. 4, 2018 in European Patent Application No. 15806095.4, 7 pages.
(Continued)

*Primary Examiner* — Mary A Davis
(74) *Attorney, Agent, or Firm* — Oblon, McClelland, Maier & Neustadt, L.L.P.

(57) ABSTRACT

A posture control unit (contact portion) that controls a posture of a balance weight-equipped slider so that a slider portion of the balance weight-equipped slider maintains the posture parallel to an orbiting bearing is provided at a position corresponding to a central portion in an axial direction of the orbiting bearing between an eccentric direction-side side surface of an eccentric shaft portion of a rotary shaft and an inner wall surface of a slide hole facing the side surface.

9 Claims, 10 Drawing Sheets

(52) U.S. Cl.
CPC ..... *F04C 29/0078* (2013.01); *F04C 2240/60* (2013.01); *F04C 2240/807* (2013.01)

(56) References Cited

FOREIGN PATENT DOCUMENTS

| | | | | |
|---|---|---|---|---|
| JP | 7-217558 | A | 8/1995 | |
| JP | 7-324689 | A | 12/1995 | |
| JP | 08-061261 | A | 3/1996 | |
| JP | 9-195956 | A | 7/1997 | |
| JP | 9-195957 | A | 7/1997 | |
| JP | 10-2286 | A | 1/1998 | |
| JP | 10-281083 | A | 10/1998 | |
| WO | WO 2015107705 | A1 * | 7/2015 | ..... F04C 18/0215 |

OTHER PUBLICATIONS

Combined Chinese Office Action and Search Report dated Jan. 12, 2018 in Chinese Patent Application No. 201580029090.X (with English translation of the Office Action and English translation of Category of Cited Documents), 16 pages.
International Search Report dated Aug. 11, 2015 in PCT/JP2015/063365 filed May 8, 2015.
European Office Action dated Aug. 28, 2018 in European Patent Application No. 15806095.4, 5 pages.
Combined Office Action and Search Report dated Aug. 21, 2018 in Chinese Patent Application No. 201580029090.X with English translation of the Office Action and English translation of categories of cited documents.

* cited by examiner (a) WHEN SCROLL BODIES ARE PRESSED (LOWER THAN PREDETERMINED OPERATING FREQUENCY)

(b) WHEN SCROLL BODIES ARE SEPARATED (EQUAL TO OR HIGHER THAN PREDETERMINED OPERATING FREQUENCY)

(a)

(b)

(a)

(b)

POSTURE CONTROL OF A BALANCE WEIGHT IN A SCROLL COMPRESSOR

TECHNICAL FIELD

The present invention relates to a scroll compressor used in an air-conditioning apparatus, a refrigeration apparatus, and other apparatuses.

BACKGROUND ART

An existing scroll compressor includes a balance weight-equipped slider in which a balance weight portion for cancelling a part or all of centrifugal force acting on an orbiting scroll is integrally attached to a slider portion (see Patent Literatures 1 and 2). The slider portion transmits rotational force of a rotary shaft to the orbiting scroll, and has a slide hole in which an eccentric shaft portion provided on an upper end of the rotary shaft to be eccentric to the axial center of the rotary shaft is slidably inserted. Further, the slider portion slidingly moves toward the eccentric shaft portion, to thereby change the orbiting radius of the orbiting scroll and form a slider mechanism that presses a scroll body side surface of the orbiting scroll against a scroll body side surface of a fixed scroll and separates the scroll body side surface of the orbiting scroll from the scroll body side surface of the fixed scroll.

CITATION LIST

Patent Literature

Patent Literature 1: Japanese Unexamined Utility Model Registration Application Publication No. 4-49602 (pages 7 to 9 and FIGS. 1 to 3)

Patent Literature 2: Japanese Unexamined Patent Application Publication No. 10-281083 (pages 7 and 8 and FIGS. 1 to 5)

SUMMARY OF INVENTION

Technical Problem

In the scroll compressor, when the rotary shaft is bent and inclined, increasing the operating frequency and the inclination of the rotary shaft, an upper end portion of the eccentric shaft portion may contact the inner wall surface of the slide hole of the slider portion. When the centrifugal force of the balance weight-equipped slider is set to be greater than the centrifugal force of the orbiting scroll, reaction force against the difference between the centrifugal force of the balance weight-equipped slider and the centrifugal force of the orbiting scroll acts on the contact position of the upper end portion of the eccentric shaft portion and the inner surface of the slide hole of the slider portion.

The contact position on which the reaction force acts is substantially distant from the center in the axial direction of the slider portion, and thus an oil film pressure distribution generated by lubricant is substantially biased in the axial direction, causing the posture of the slider portion difficult to be controlled during the operation. Consequently, the outer circumferential surface of the slider portion is inclined to an orbiting bearing, the load capacity of the orbiting bearing is reduced, and the outer circumferential surface of the slider portion partially contacts the orbiting bearing, causing abrasion and an operation failure due to seizure.

Consequently, the inclination of the slider portion to the orbiting bearing attributed to the bend of the rotary shaft has been desired to be minimized. The bent of the rotary shaft, however, is not mentioned at all in Patent Literatures 1 and 2, and the inclination of the slider portion to the orbiting bearing attributed to the bend of the rotary shaft has not actually been minimized.

The present invention has been made in view of such an issue, and aims to obtain a scroll compressor capable of minimizing the partial contact of the slider portion against the orbiting bearing due to the inclination of the rotary shaft.

Solution to Problem

A scroll compressor according to an embodiment of the present invention includes a fixed scroll provided in a container, an orbiting scroll configured to orbit relative to the fixed scroll, a rotary shaft configured to transmit rotational drive force to the orbiting scroll, an eccentric shaft portion provided on one end side of the rotary shaft to be eccentric to the rotary shaft, a balance weight-equipped slider integrated of a slider portion having a slide hole and a balance weight portion, in a plane perpendicular to an axis of the rotary shaft, movable along the slide hole relative to the eccentric shaft portion inserted in the slide hole, and having centrifugal force set to be greater than centrifugal force of the orbiting scroll, an orbiting bearing provided to the orbiting scroll and rotatably supporting the slider portion of the balance weight-equipped slider, and a posture control unit provided at a position corresponding to a central portion in an axial direction of the orbiting bearing between an eccentric direction-side side surface of the eccentric shaft portion and an inner wall surface of the slide hole facing the side surface, and configured to control a posture of the balance weight-equipped slider so that the slider portion of the balance weight-equipped slider maintains the posture parallel to the orbiting bearing.

Advantageous Effects of Invention

The embodiment of the present invention minimizes the partial contact of the slider portion against the orbiting bearing due to the inclination of the rotary shaft.

DESCRIPTION OF EMBODIMENTS

Embodiment 1

Figure 1:
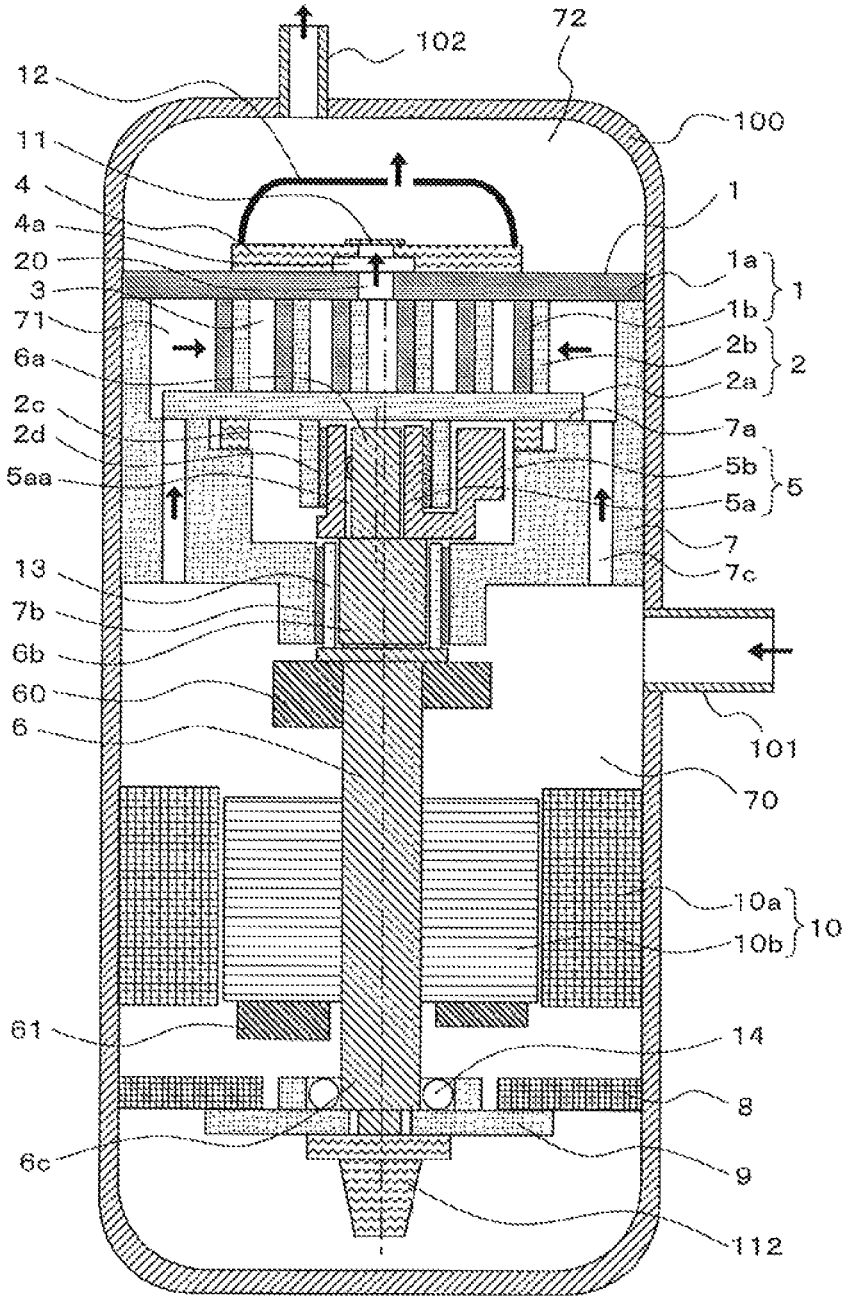
FIG. 1 is a vertical cross-sectional view illustrating a configuration of a scroll compressor according to Embodiment 1 of the present invention.

A scroll compressor according to Embodiment 1 of the present invention will be described. FIG. 1 is a vertical cross-sectional view illustrating a configuration of the scroll compressor according to Embodiment 1 of the present invention.

A scroll compressor is one of component elements of a refrigeration cycle used for purposes such as a refrigerator, a freezer, a vending machine, an air-conditioning apparatus, a refrigeration apparatus, and a hot water supply apparatus, and suctions and compresses working gas, such as refrigerant, circulating through the refrigeration cycle, and discharges the working gas in a high-temperature, high-pressure state. In all drawings, the dimensional relationships between component members and the shapes and other features of the component members may be different from actual ones. Further, in all drawings, parts assigned with the same reference signs are the same or correspond to one another, and the reference signs apply to the entire text of the specification.

The scroll compressor is configured to have a fixed scroll 1, an orbiting scroll 2, a rotary shaft 6, a frame 7, a sub-frame plate 8 fixed with a sub-frame 9, an electric motor 10, a first balance weight 60, a second balance weight 61, and other devices stored in an airtight container 100. The frame 7 and the sub-frame plate 8 are fixed to the airtight container 100. The frame 7 fixedly disposes the fixed scroll 1. Further, with a thrust surface 7*a*, the frame 7 supports, in the axial direction, thrust force acting on the orbiting scroll 2. A part of a side surface of the airtight container 100 is connected to a suction pipe 101 for suctioning the working gas. An upper surface of the airtight container 100 is connected to a discharge pipe 102 for discharging the compressed working gas.

The fixed scroll 1 includes a baseplate 1*a* and a scroll body 1*b* provided to stand on one surface of the baseplate 1*a*. A discharge port 20 for discharging the compressed working gas is formed to pass through a substantially central portion of the baseplate 1*a*. An exit portion of the discharge port 20 communicates with a discharge port 4*a* formed in a baffle 4, and the discharge port 4*a* is provided with a discharge valve 11 that opens when a pressure of a later-described compression chamber 3 reaches or exceeds a predetermined pressure. Further, the baffle 4 is attached with a discharge muffler container 12 to cover the discharge valve 11.

The orbiting scroll 2 includes a baseplate 2*a* and a scroll body 2*b* provided to stand on one surface of the baseplate 2*a*. A hollow cylindrical boss 2*c* is formed in a substantially central portion of a surface of the baseplate 2*a* of the orbiting scroll 2 opposite to the surface formed with the scroll body 2*b*, and an orbiting bearing 2*d* is fixed to the inner circumferential surface of the boss 2*c*. An eccentric shaft portion 6*a* formed on one end (upper end) of the rotary shaft 6 is inserted in the orbiting bearing 2*d* via a slider portion 5*a* of a later-described balance weight-equipped slider 5. The rotation of the rotary shaft 6 causes the orbiting scroll 2 to orbit (revolve). A not-illustrated Oldham's mechanism causes the orbiting scroll 2 to face the fixed scroll 1 and orbit, without rotating. For example, the orbiting bearing 2*d* is made of a bearing material for use in a slide bearing, such as a copper-lead alloy, fixed by press fitting or another technique.

The fixed scroll 1 and the orbiting scroll 2 are fitted to each other so that the scroll body 1*b* and the scroll body 2*b* mesh with each other. The compression chamber 3 for compressing the working gas is formed between the scroll body 1*b* and the scroll body 2*b*. The capacity of the compression chamber 3 changes as the orbiting scroll 2 orbits.

The electric motor 10 includes an electric motor stator 10*a* and an electric motor rotator 10*b*. The electric motor stator 10*a* is fixed to the airtight container 100 by shrink fitting or another technique, and is connected with a lead wire (not illustrated) to a glass terminal (not illustrated) fixed to the frame 7 to obtain electric power from outside. The electric motor rotator 10*b* is fixed to the rotary shaft 6 by shrink fitting or another technique, and is configured to rotate with the rotary shaft 6 with power supplied to the electric motor stator 10*a*.

The rotary shaft 6 transmits rotational drive force of the electric motor 10 to the orbiting scroll 2 to cause the orbiting scroll 2 to orbit. A main shaft portion 6*b* of an upper portion of the rotary shaft 6 is fitted, via a sleeve 13, in a main bearing 7*b* provided in a central portion of the frame 7, faces the main bearing 7*b* via an oil film of lubricant, and rotatably and slidingly moves. A sub-shaft portion 6*c* of a lower portion of the rotary shaft 6 is fitted in a sub-bearing 14 formed of a ball bearing provided in a central portion of the sub-frame plate 8, faces the sub-bearing 14 via an oil film of lubricant, and rotatably and slidingly moves. The sub-bearing 14 may have the configuration of another bearing other than the ball bearing. The respective axial centers of the main shaft portion 6*b* and the sub-shaft portion 6*c* corresponds to the axial center of the rotary shaft 6.

The upper end of the rotary shaft 6 is provided with the eccentric shaft portion 6*a* projecting eccentrically to the axial center of the rotary shaft 6. The eccentric shaft portion 6*a* is inserted in a slide hole 5*aa* (see FIG. 2) formed in the slider portion 5*a* of the balance weight-equipped slider 5.

The lower end of the rotary shaft 6 is attached with a pump element 112. The interior of the rotary shaft 6 is formed with not-illustrated oil supply paths serving as flow paths for oil. The oil stored in a bottom part of the airtight container 100 is pumped up by the pump element 112 and supplied to slidingly movable units, such as bearings, through the oil supply paths. Further, the pump element 112 supports the rotary shaft 6 in the axial direction with an upper end surface of the pump element 112.

The balance weight-equipped slider 5 is configured to have the substantially cylindrical slider portion 5*a* and a balance weight portion 5*b* fastened to the slider portion 5*a* that are integrated as the balance weight-equipped slider 5. The balance weight-equipped slider 5 may be formed of a single member, or may be a plurality of members fastened to each other to be integrated.

The slider portion 5*a* transmits the rotational force of the rotary shaft 6 to the orbiting scroll 2. By inserting the eccentric shaft portion 6*a* into the slide hole 5*aa* provided in the slider portion 5*a*, the balance weight-equipped slider 5 is movable around the eccentric shaft portion 6*a* along the slide hole 5*aa* in a plane perpendicular to the axis of the rotary shaft 6. Further, the slider portion 5*a* per se is rotatably supported inside the orbiting bearing 2*d*. Further, while the eccentric shaft portion 6*a* is inserted in the slider portion 5*a*, an axial center (central axis) Y of the slider portion 5*a* is eccentric to an axial center X of the rotary shaft 6 by a predetermined size e (see FIG. 4). When the rotary shaft 6 rotates, the slider portion 5*a* rotates integrally with the eccentric shaft portion 6*a*, thereby causing the orbiting scroll 2 to orbit, and making the predetermined size e to be a normal orbiting radius of the orbiting scroll 2.

The balance weight portion 5*b* generates centrifugal force in a counter-eccentric direction opposite to an eccentric direction of the eccentric shaft portion 6*a* to the rotary shaft 6, to thereby cancel centrifugal force acting on the orbiting scroll 2.

The balance weight-equipped slider 5 configured as described above is moved relatively to the eccentric shaft portion 6*a* by the force due to the pressure of the working gas in the compression chamber 3, the centrifugal force acting on the orbiting scroll 2, the centrifugal force acting on the balance weight portion 5*b*, and other forces, and forms a variable crank mechanism that automatically adjusts the orbiting radius of the orbiting scroll 2 during an orbiting operation of the orbiting scroll 2.

The variable crank mechanism opens no gap between the scroll body side surface of the fixed scroll 1 and the scroll body side surface of the orbiting scroll 2 in a state in which the balance weight-equipped slider 5 is moved to the maximum extent in the eccentric direction (that is, a state in which the orbiting scroll 2 is located at the position of the normal orbiting radius e), and presses the scroll body 1*b* of the fixed scroll 1 and the scroll body 2*b* of the orbiting scroll 2 each other. Meanwhile, when the balance weight-equipped slider 5 moves in the counter-eccentric direction, a gap is formed between the scroll body 1*b* of the fixed scroll 1 and the scroll body 2*b* of the orbiting scroll 2, and the scroll body 1*b* of the fixed scroll 1 and the scroll body 2*b* of the orbiting scroll 2 separate from each other.

The first balance weight 60 and the second balance weight 61 cancel imbalance caused by the orbiting scroll 2 and the balance weight-equipped slider 5, and are provided to the rotary shaft 6 and the electric motor 10, respectively.

A description will be given below of flow of refrigerant. Low-pressure refrigerant flowing from the suction pipe 101 into a lower space 70 of the frame 7 in the airtight container 100 flows into an intermediate space 71 of the frame 7 through two communication flow paths 7*c* provided in the frame 7. The low-pressure refrigerant flowing into the intermediate space 71 is suctioned into the compression chamber 3 formed between the orbiting scroll 2 and the fixed scroll 1 as the orbiting scroll 2 orbits. The refrigerant is increased in pressure from a low pressure to a high pressure by a geometrical change in capacity of the compression chamber 3 as the orbiting scroll 2 orbits, and is discharged into the discharge muffler container 12 via the discharge port 20, the discharge port 4*a*, and the discharge valve 11. The refrigerant discharged into the discharge muffler container 12 is then discharged to the outside of the compressor as high-pressure refrigerant from the discharge pipe 102 via an upper space 72 above the fixed scroll 1.

Figure 2:
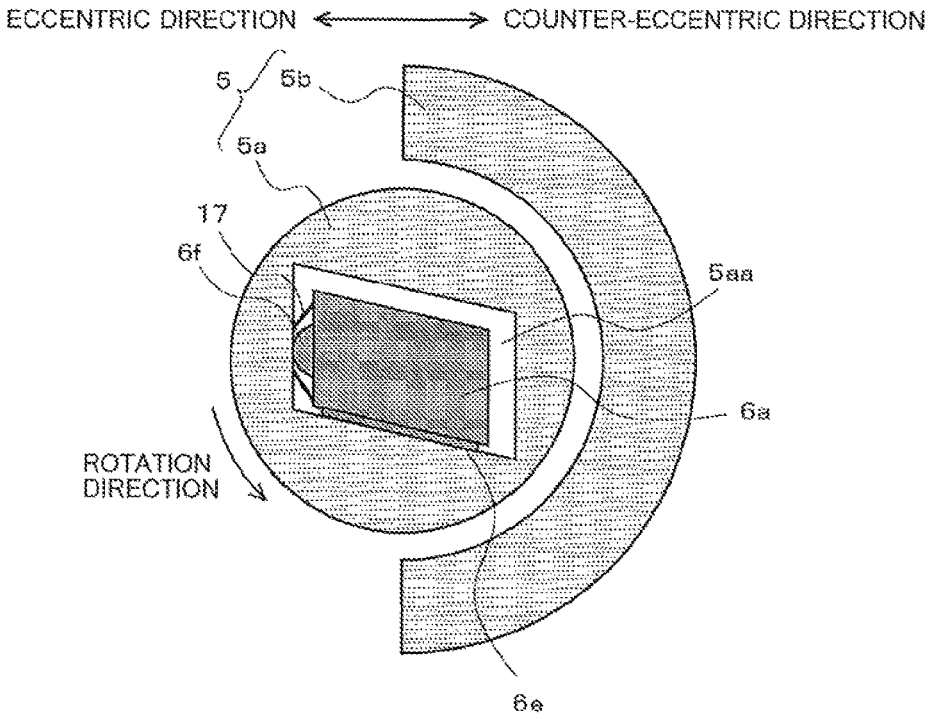
FIG. 2 is a horizontal cross-sectional view of components in the vicinity of a balance weight-equipped slider 5 of the scroll compressor according to Embodiment 1 of the present invention.
Figure 3:
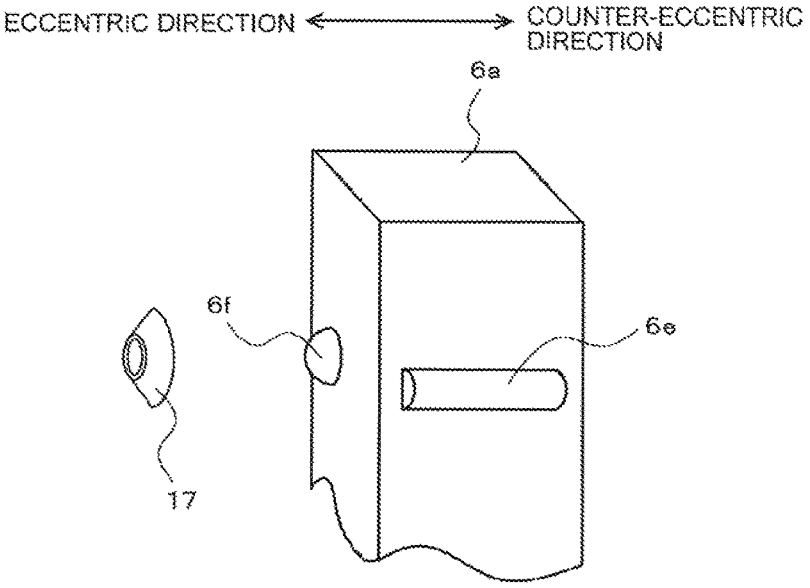
FIG. 3 is a perspective view of components in the vicinity of an eccentric shaft portion 6*a* of a rotary shaft 6 of the scroll compressor according to Embodiment 1 of the present invention.

FIG. 2 is a horizontal cross-sectional view of components in the vicinity of the balance weight-equipped slider 5 of the scroll compressor according to Embodiment 1 of the present invention. FIG. 3 is a perspective view of components in the vicinity of the eccentric shaft portion 6*a* of the rotary shaft 6 of the scroll compressor according to Embodiment 1 of the present invention. In FIGS. 2 and 3, the left direction and the right direction respectively correspond to the eccentric direction and the counter-eccentric direction of the orbiting scroll 2 to the rotary shaft 6.

The eccentric shaft portion 6*a* of the rotary shaft 6 includes a contact portion 6*e* formed of a semicylindrical convex portion that constantly and slidably contacts an inner wall surface of the slide hole 5*aa* of the slider portion 5*a*. The eccentric shaft portion 6*a* of the rotary shaft 6 further includes, on an eccentric direction-side side surface of the eccentric shaft portion 6*a*, a contact portion 6*f* formed of a hemispherical convex portion. The contact portions 6*e* and 6*f* are provided at a height position corresponding to a central portion in the axial direction of the orbiting bearing 2*d*. The contact portions 6*e* and 6*f* are formed integrally with the eccentric shaft portion 6*a*.

Further, an elastic body 17 that biases the slider portion 5*a* toward the eccentric direction to press the orbiting scroll 2 toward the eccentric direction is provided between the contact portion 6*f* and an eccentric direction-side inner wall surface of the slide hole 5*aa*. In Embodiment 1, the elastic body 17 is formed of a disc spring.

A description will be given below of the positional relationship between the balance weight-equipped slider 5, the eccentric shaft portion 6*a*, and the orbiting scroll 2.

Figure 4:
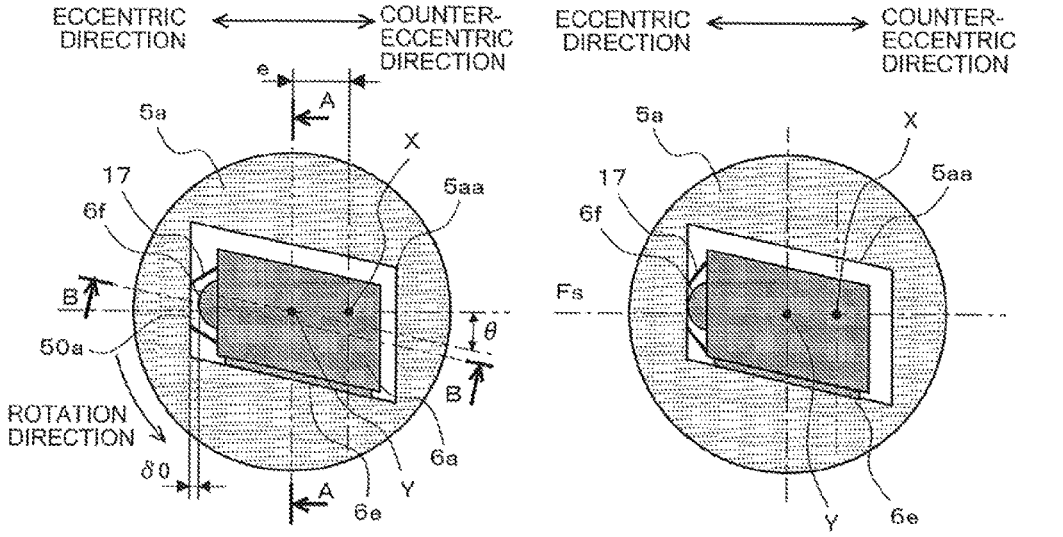
FIG. 4 includes diagrams illustrating operations of the balance weight-equipped slider 5 of the scroll compressor according to Embodiment 1 of the present invention.

The balance weight-equipped slider 5 is movable relatively to the eccentric shaft portion 6*a* in the eccentric direction or the counter-eccentric direction, and the position of the orbiting scroll 2 changes depending on the position of the balance weight-equipped slider 5. With reference to FIG. 4 below, a description will be given below of the positional relationship between the balance weight-equipped slider 5 and the eccentric shaft portion 6*a* in each of a scroll body pressed state in which the scroll body 2*b* of the orbiting scroll 2 is pressed against the scroll body 1*b* of the fixed scroll 1 and a scroll body separated state in which the scroll body 2*b* of the orbiting scroll 2 is separated from the scroll body 1*b* of the fixed scroll 1.

FIG. 4 includes diagrams illustrating operations of the balance weight-equipped slider 5 of the scroll compressor according to Embodiment 1 of the present invention. In FIG.

4, (a) illustrates the scroll body pressed state, and (b) illustrates the scroll body separated state. In FIG. 4, the left direction and the right direction respectively correspond to the eccentric direction and the counter-eccentric direction of the orbiting scroll 2 to the rotary shaft 6. Further, in FIG. 4, X represents the axial center of the rotary shaft 6, and Y represents the axial center of the orbiting bearing 2*d* (the same as the axial center of the slider portion 5*a*). The positional relationship between the slider portion 5*a* and the eccentric shaft portion 6*a* in the scroll body pressed state and the positional relationship between the slider portion 5*a* and the eccentric shaft portion 6*a* in the scroll body separated state will sequentially be described below.

In FIG. 4, (a) illustrates the position of the balance weight-equipped slider 5 when the orbiting scroll 2 orbits with the normal orbiting radius e, and the illustrated position is also an initial position at startup (when the operation is stopped). Further, in a state in which the orbiting scroll 2 is located at the position of the normal orbiting radius e (the initial position), an initial gap 50*a* is set in the eccentric direction between the slide hole 5*aa* and the contact portion 6*f* of the eccentric shaft portion 6*a*, and the balance weight-equipped slider 5 is movable relatively to the eccentric shaft portion 6*a* in the counter-eccentric direction from the initial position by a distance δ0 of the initial gap 50*a*. In the state in which the balance weight-equipped slider 5 is located at the initial position, the elastic body 17 biases the slider portion 5*a* toward the eccentric direction to press the orbiting scroll 2 toward the eccentric direction, and has a function of ensuring initial startup performance immediately after the start of the operation. This point will be described later.

In FIG. 4, (b) illustrates the positional relationship between the balance weight-equipped slider 5 and the eccentric shaft portion 6*a* in the separated state in which the balance weight-equipped slider 5 is moved from the initial position in (a) of FIG. 4 in the counter-eccentric direction by the distance 80, and the scroll body side surface of the orbiting scroll 2 is separated from the scroll body side surface of the fixed scroll 1. The separation distance between the scroll bodies 1*b* and 2*b* in this state corresponds to the distance δ0. That is, since the distance δ0 of the initial gap 50*a* corresponds to the separation distance between the scroll bodies 1*b* and 2*b*, the distance δ0 is specified to minimize leakage occurring in the gap in the separated state.

Forces acting in the radial direction of the balance weight-equipped slider 5 will be described here.

Figure 5:
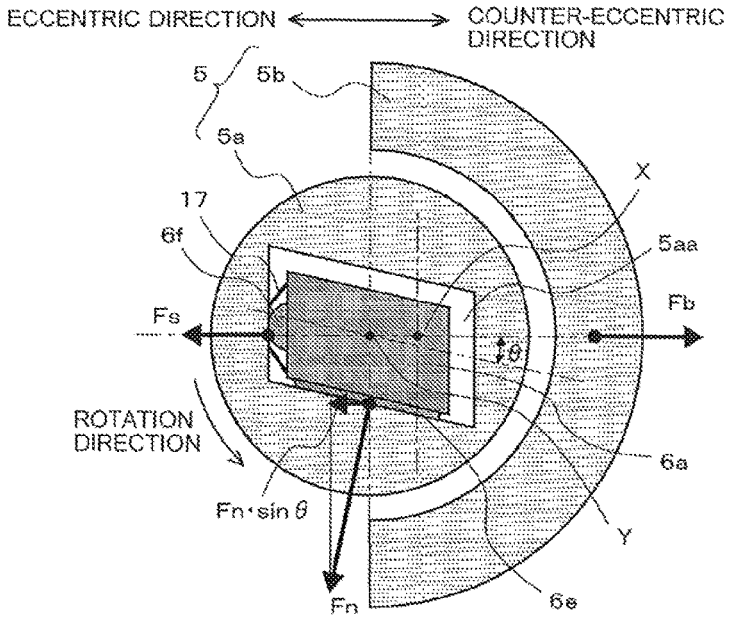
FIG. 5 is a diagram illustrating forces acting on the balance weight-equipped slider 5 of the scroll compressor according to Embodiment 1 of the present invention.

FIG. 5 is a diagram illustrating forces acting on the balance weight-equipped slider 5 of the scroll compressor according to Embodiment 1 of the present invention.

In Embodiment 1, a centrifugal force Fb of the balance weight-equipped slider 5 is set to be greater than a centrifugal force Fc (not illustrated) of the orbiting scroll 2. Consequently, the centrifugal force Fb of the balance weight-equipped slider 5 cancels the entire centrifugal force Fc of the orbiting scroll 2, and a separation contributory load Fr for separating the scroll bodies 1*b* and 2*b* from each other acts in the radial direction of the balance weight-equipped slider 5 owing to the difference from the centrifugal force Fc. In this state, the separation contributory load Fr is represented as:

$$Fr=Fb-Fc$$

The separation contributory load Fr is the difference between the centrifugal force Fc and the centrifugal force Fb, and thus increases in proportion to the square of the operating frequency of the scroll compressor.

Further, due to the elastic body 17 provided between the inner wall surface of the slide hole 5*aa* of the slider portion 5*a* and the eccentric shaft portion 6*a*, an elastic force Fs for pressing the slider portion 5*a* in the eccentric direction, that is, an elastic force Fs for pressing the scroll bodies 1*b* and 2*b* against each other, acts on the slider portion 5*a*. When the amount of deformation of the elastic body 17 is constant, the elastic force Fs is constant regardless of the operating frequency.

Further, the direction of the slide hole 5*aa* and the eccentric shaft portion 6*a* is inclined to the eccentric direction of the orbiting scroll 2 by a predetermined amount (inclination angle) θ. Consequently, a component force Fn·sin θ of a reaction force (drive transmitting reaction force) Fn against the pressure of the working gas further acts on the balance weight-equipped slider 5. The component force Fn·sin θ is substantially constant regardless of the operating frequency, when pressure conditions are the same. A resultant force of these forces acts in the radial direction of the balance weight-equipped slider 5 as a pressing contributory load Fp for pressing the scroll bodies 1*b* and 2*b* against each other. The pressing contributory load Fp is represented as:

$$Fp=Fs+Fn\cdot\sin\theta$$

The pressing contributory load Fp is obtained by adding up the elastic force Fs and the component force Fn·sin θ, and thus is constant regardless of the operating frequency.

With the separation contributory load Fr and the pressing contributory load Fp described above, a pressing load Fw for pressing the scroll bodies 1*b* and 2*b* against each other acts on the balance weight-equipped slider 5 in the eccentric direction. The pressing load Fw is represented as:

Fw=Fp−Fr, when the relationship of Fp−Fr>0 is satisfied, and

Fw=0, when the relationship of Fp−Fr≤0 is satisfied.

The foregoing drive transmitting reaction force Fn is based on the pressure of the working gas associated with the compression inside the compression chamber 3, and thus does not affect the pressing load Fw when the operation is stopped or immediately after the start of the operation.

Figure 6:
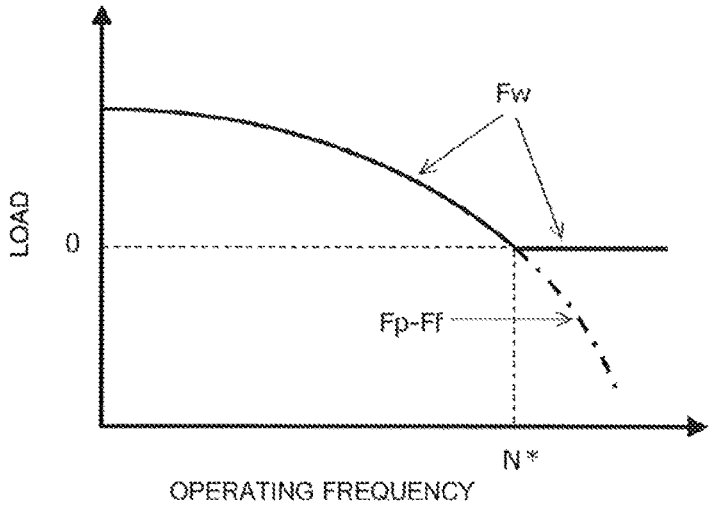
FIG. 6 is a graph illustrating the relationship between an operating frequency of the scroll compressor according to Embodiment 1 of the present invention and a pressing load Fw for pressing scroll bodies 1*b* and 2*b* against each other.

FIG. 6 is a graph illustrating the relationship between the operating frequency of the scroll compressor according to Embodiment 1 of the present invention and the pressing load Fw for pressing the scroll bodies 1*b* and 2*b* against each other. In the graph, the horizontal axis represents the operating frequency, and the vertical axis represents the pressing load Fw. In the drawing, a solid line represents the value of Fw, and a broken line represents the value of Fp−Fr.

In Embodiment 1, the centrifugal force Fb of the balance weight-equipped slider 5, the centrifugal force Fc of the orbiting scroll 2, the elastic force Fs of the elastic body 17, and the inclination angle θ are specified. Thus, in an operation range lower than a predetermined operating frequency N*, the pressing load Fw is greater than 0, and the scroll bodies 1*b* and 2*b* press each other (the state in (a) of FIG. 4).

Meanwhile, in an operation range equal to or higher than the predetermined operating frequency N*, the pressing load Fw is equal to 0, and the scroll bodies 1*b* and 2*b* separate from each other (the state in (b) of FIG. 4).

That is, from the startup time to the time before the operating frequency reaches the predetermined operating frequency N*, the separation contributory load Fr is small, and the pressing contributory load Fp corresponding to the resultant force of the elastic force Fs and the component force Fn·sin θ is greater than the separation contributory load Fr, and thus the balance weight-equipped slider 5 is located at the initial position illustrated in (a) of FIG. 4. Then, when the operating frequency reaches or exceeds the predetermined operating frequency N*, the separation contributory load Fr increases, and when the separation contributory load Fr equals or exceeds the pressing contributory load Fp, the balance weight-equipped slider 5 moves relatively to the eccentric shaft portion 6*a* in the counter-eccentric direction, as illustrated in (b) of FIG. 4. With this movement, the orbiting scroll 2 also moves in the counter-eccentric direction (that is, a direction of reducing the orbiting radius).

In the operation range equal to or higher than the predetermined operating frequency N*, the pressing load Fw is 0, and the two scroll bodies 1*b* and 2*b* separate from each other (the state in (b) of FIG. 4). As described above, the scroll bodies 1*b* and 2*b* press each other in a low-speed operation in which gas leakage highly contributes to the loss, and the scroll bodies 1*b* and 2*b* separate from each other in a high-speed operation in which sliding movement highly contributes to the loss, thereby improving the performance of the compressor in a wide operation range. Further, the pressing load Fw is applied by the elastic body 17 from the time in which the operation is stopped, to reliably assist the compression inside the compression chamber 3, thereby ensuring the initial startup performance immediately after the start of the operation. Further, the distance δ0 of the initial gap 50*a* (illustrated in FIG. 4) for allowing the separation distance between the scroll bodies 1*b* and 2*b* is specified as described above, to thereby control the gap formed between the respective scroll body side surfaces of the two scroll bodies 1*b* and 2*b* in the separated state, and minimize the leakage occurring in the gap in the separated state.

Operations of the contact portions 6*e* and 6*f* provided to the eccentric shaft portion 6*a* will be described below. In the eccentric shaft portion 6*a*, the contact portion 6*e* transmits the rotational drive force of the rotary shaft 6 to the orbiting scroll 2. Providing the contact portion 6*e* to the eccentric shaft portion 6*a* and forming the contact portion 6*e* into a semicylindrical shape have been conventionally known. Herein, the operation of the contact portion 6*e* will first be described, and the operation of the contact portion 6*f* that corresponds to a feature of the present invention will then be described.

Figure 7:
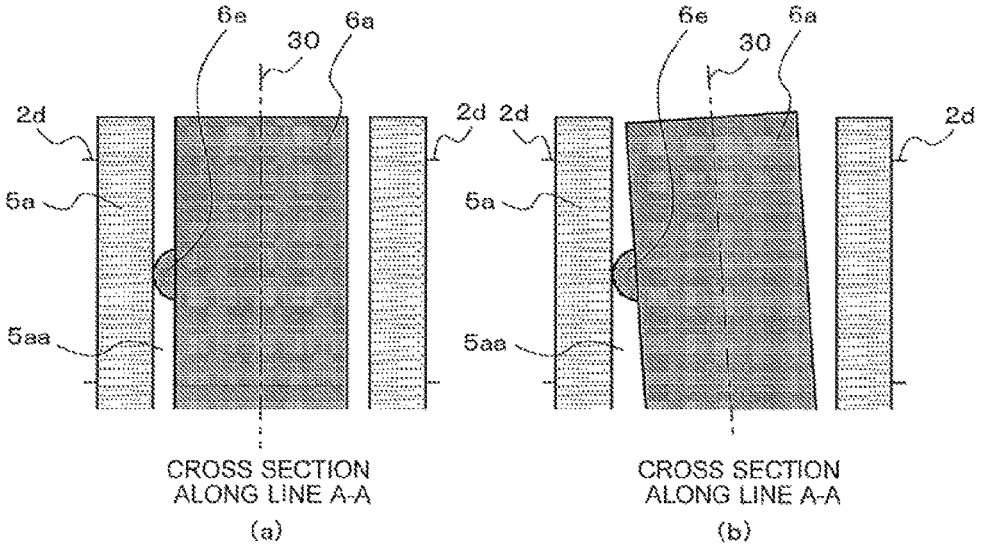
FIG. 7 includes diagrams illustrating behaviors in a cross section along line A-A in FIG. 4.

FIG. 7 is diagrams illustrating behaviors in a cross section along line A-A in FIG. 4, (a) of FIG. 7 illustrates a state in which the operation is stopped, and (b) of FIG. 7 illustrates an inclined state of the rotary shaft 6 after the start of the operation. In FIG. 7, a reference sign 30 represents the central axis of the eccentric shaft portion 6*a*.

When the operation is stopped, the eccentric shaft portion 6*a* and the slider portion 5*a* are parallel to each other, as illustrated in (a) of FIG. 7. Further, to transmit the rotational drive force of the rotary shaft 6 to the slider portion 5*a*, the contact portion 6*e* is in contact with the inner wall surface of the slide hole 5*aa* via a slider plate (not illustrated), as illustrated in (a) of FIG. 4 and (a) of FIG. 7. Then, when the operation starts, an upper end portion side of the rotary shaft 6 is bent and inclined toward the contact portion 6*e* (hereinafter, toward the rotational force transmission direction) and toward the contact portion 6*f* (that is, toward the eccentric direction) by the centrifugal forces of the balance weight portion 5*b*, the first balance weight 60, and the second balance weight 61, a component force Fn·cos θ of the drive transmitting reaction force Fn, and other forces.

The contact portion 6*e* operates in response to the inclination of the rotary shaft 6 toward the rotational force transmission direction. As illustrated in (b) of FIG. 7, when the upper end portion side of the rotary shaft 6 is inclined toward the rotational force transmission direction, the eccentric shaft portion 6*a* has a posture inclined to the central axis 30 of the eccentric shaft portion 6*a* at a time when the operation is stopped. Herein, the contact portion 6*e* has the semicylindrical shape, and thus the contact portion 6*e* can contact the slider portion 5*a* while the posture of the slider portion 5*a* is controlled to be parallel to the orbiting bearing 2*d*, regardless of the inclination angle of the eccentric shaft portion 6*a*.

The operation of the contact portion 6*f*, which corresponds to a feature of the present invention, will be described below. The contact portion 6*f* operates in response to the inclination toward the eccentric direction. The present invention aims to minimize the inclination of the slider portion 5*a* to the orbiting bearing 2*d* by preventing the inclination in the eccentric direction of the eccentric shaft portion 6*a* attributed to the bend of the rotary shaft 6 from being transmitted to the slider portion 5*a*. As a method for the aim, the contact portion 6*f* serving as a posture control unit is provided.

Figure 8:
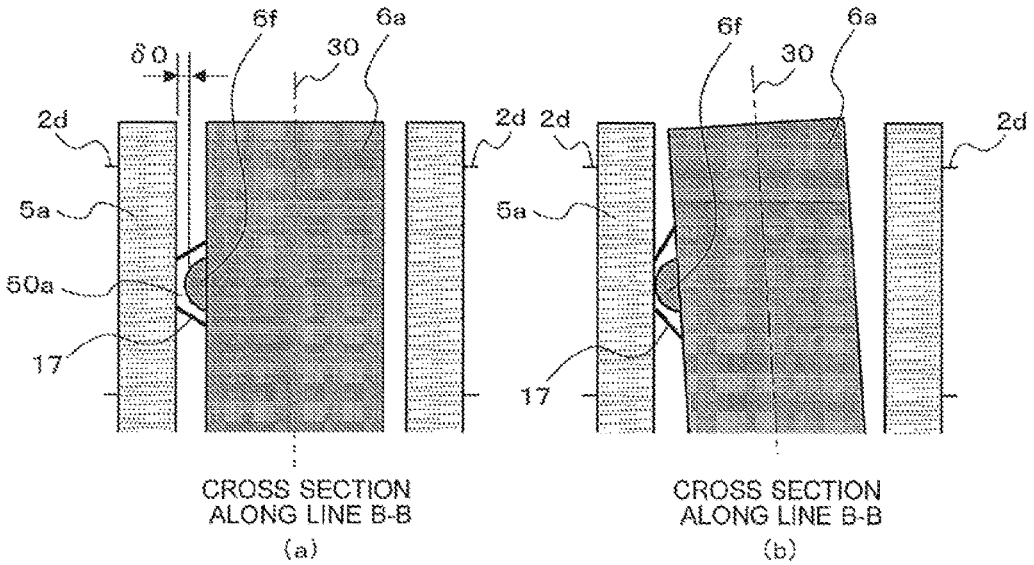
FIG. 8 includes diagrams illustrating behaviors in a cross section along line B-B in FIG. 4.
Figure 9:
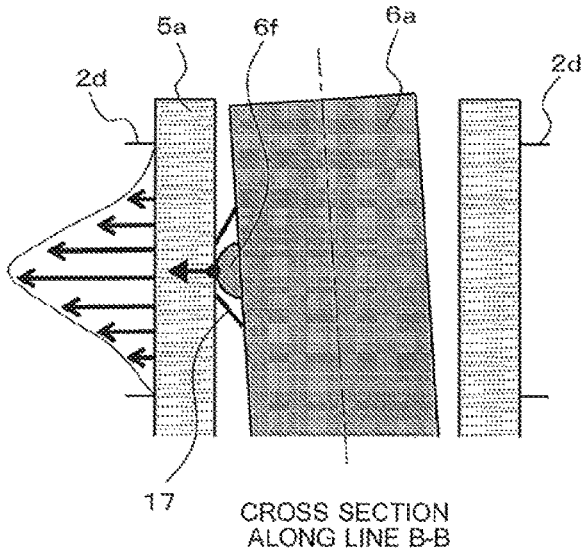
FIG. 9 is a diagram illustrating an oil film pressure distribution lying on an orbiting bearing 2*d* of the scroll compressor according to Embodiment 1 of the present invention.

FIG. 8 is diagrams illustrating behaviors in a cross section along line B-B in FIG. 4, (a) of FIG. 8 illustrates a state in which the operation is stopped, and (b) of FIG. 8 illustrates an inclined state of the rotary shaft 6 after the start of the operation. In FIG. 8, a reference sign 30 represents the central axis of the eccentric shaft portion 6*a*. FIG. 9 is a diagram illustrating an oil film pressure distribution lying on the orbiting bearing 2*d* of the scroll compressor according to Embodiment 1 of the present invention.

At the operating frequency when the scroll bodies 1*b* and 2*b* press each other (lower than the predetermined operating frequency N*), the eccentric shaft portion 6*a* including the contact portion 6*f* does not contact the slider portion 5*a* even when the eccentric shaft portion 6*a* is inclined toward the eccentric direction from the central axis 30 at a time when the operation is stopped, because the initial gap 50*a* is formed between the contact portion 6*f* and the slide hole 5*aa*, as illustrated in (a) of FIG. 8.

Meanwhile, at the operating frequency when the scroll bodies 1*b* and 2*b* separate from each other (equal to or higher than the predetermined operating frequency N*), the contact portion 6*f* and the slide hole 5*aa* contact each other, as described above. That is, when the scroll bodies 1*b* and 2*b* separate from each other, the eccentric shaft portion 6*a* contacts the inner wall surface of the slider portion 5*a* at two positions of the contact portions 6*e* and 6*f*. Further, with the contact portion 6*e* and the contact portion 6*f* formed into the semicylindrical shape and the hemispherical shape, respectively, the operation can be performed without the inclination of the slider portion 5*a* even with the contact at the two positions. In this state, the contact portion 6*e* is in line contact and the contact portion 6*f* is in point contact, when minute elastic deformation of the contact portions is disregarded.

Further, because the hemispherical contact portion 6*f* is provided at the position corresponding to the central portion in the axial direction of the orbiting bearing 2*d*, a contact load generated by the contact portion 6*e* acts on a position corresponding to the central portion in the axial direction of the orbiting bearing 2*d*. Consequently, the oil film pressure distribution of the orbiting bearing 2*d* is rendered as a distribution maximized around the central portion in the axial direction of the orbiting bearing 2*d*, that is, an unbiased distribution, as illustrated in FIG. 9. Consequently, the slider portion 5*a* can be maintained in the posture parallel to the orbiting bearing 2*d*.

As described above, in Embodiment 1, the hemispherical contact portion 6*f* is provided at the position corresponding to the central portion in the axial direction of the orbiting bearing 2*d* on the eccentric direction-side side surface of the eccentric shaft portion 6*a*. With this configuration, when the upper end portion side of the rotary shaft 6 is bent and inclined toward the eccentric direction, the eccentric shaft portion 6*a* is inclined to the slider portion 5*a* with the contact portion 6*f* serving as a fulcrum, and the oil film pressure acting on the orbiting bearing 2*d* in this process is distributed substantially symmetrically in the axial direction around the central portion in the axial direction of the orbiting bearing 2*d*. The slider portion 5*a* can be therefore controlled during the operation to have the posture parallel to the orbiting bearing 2*d* without being inclined to the orbiting bearing 2*d*. This configuration ensures the load capacity of the orbiting bearing 2*d*, and minimizes the abrasion and seizure due to the partial contact of the outer circumferential surface of the slider portion 5*a* against the orbiting bearing 2*d*.

Further, initial pressing force (the pressing load Fw) is applied to the scroll body side surfaces by the elastic body 17 from the time in which the operation is stopped, to reliably assist the compression inside the compression chamber 3, thereby ensuring the initial startup performance immediately after the start of the operation. Although Embodiment 1 is configured to include the elastic body 17, the contact portion 6*f* is also effective in a configuration not including the elastic body 17 in controlling the posture of the slider portion 5*a*.

Further, because the elastic body 17 is formed of a disc spring and disposed to surround the contact portion 6*f*, the operation can be performed without inclination of the outer circumferential surface of the slider portion 5*a* to the orbiting bearing 2*d*, with the elastic body 17 for ensuring the initial pressing force stored in the slide hole 5*aa* of the slider portion 5*a*.

Figure 10:
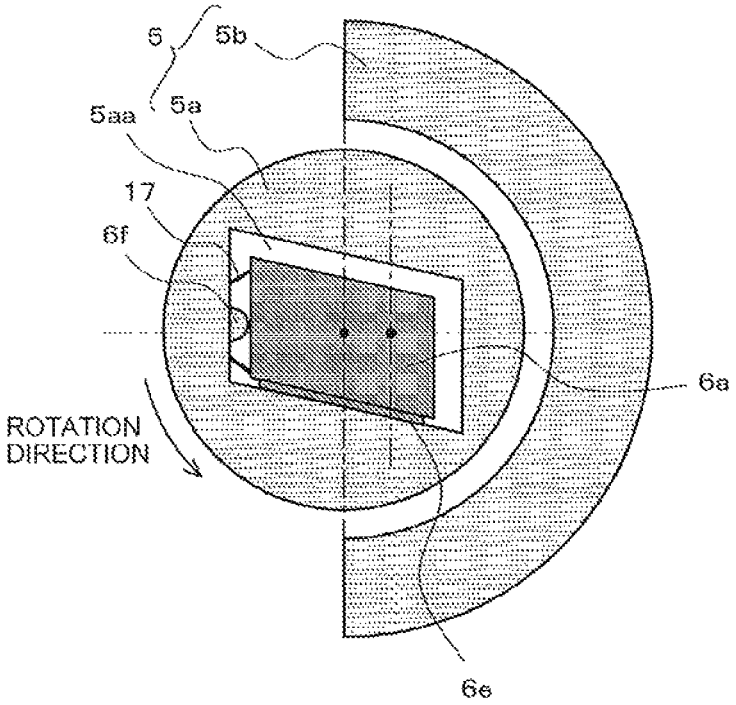
FIG. 10 is a cross-sectional view of components in the vicinity of the eccentric shaft portion 6*a* of the rotary shaft 6 in a modified example of the scroll compressor according to Embodiment 1 of the present invention.

Further, Embodiment 1 is configured to include the contact portion 6*f* on the eccentric direction-side side surface of the eccentric shaft portion 6*a*, but may be configured to include the contact portion 6*f* on the eccentric direction-side inner wall surface of the slide hole 5*aa*, as illustrated in FIG. 10.

Further, each of the slide hole 5*aa* and the eccentric shaft portion 6*a* has the shape of a parallelogram in Embodiment 1, as viewed in the axial direction, but is not limited to this shape, and may have another shape. For example, each of the slide hole 5*aa* and the eccentric shaft portion 6*a* may have a rectangular shape.

Embodiment 2

Embodiment 2 is different from Embodiment 1 in the shape of the contact portion 6*f*, and items not particularly described in Embodiment 2 are similar to those in Embodiment 1. The following description will focus on differences of Embodiment 2 from Embodiment 1.

Figure 11:
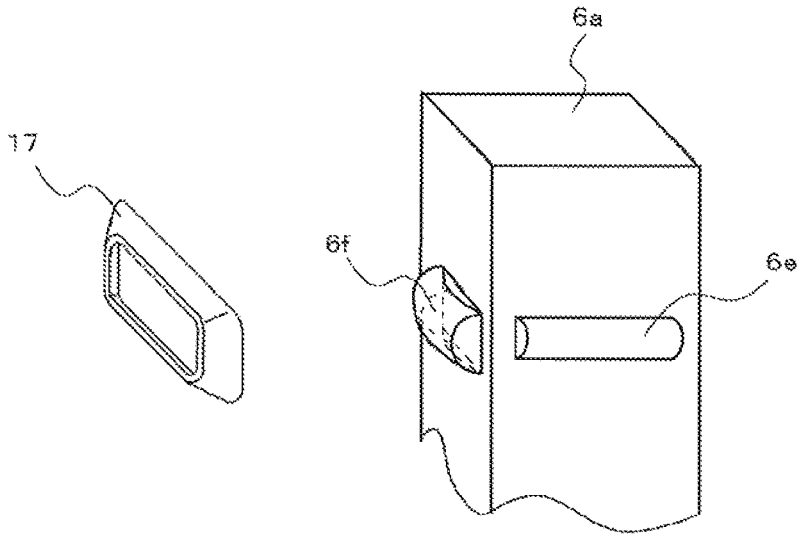
FIG. 11 includes perspective views of components in the vicinity of the eccentric shaft portion 6*a* of the rotary shaft 6 in a scroll compressor according to Embodiment 2 of the present invention.
Figure 11:
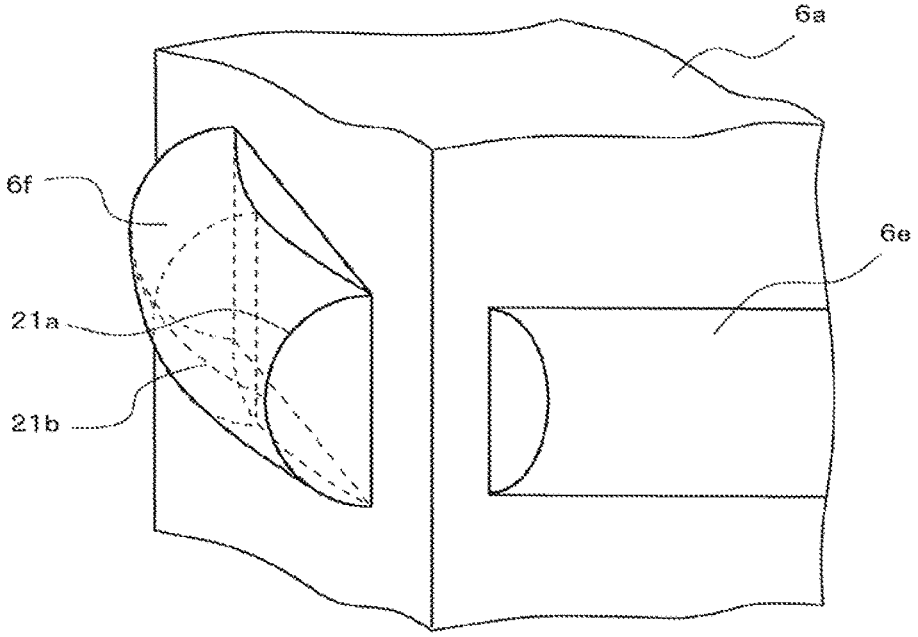

FIG. 11 includes perspective views of components in the vicinity of the eccentric shaft portion 6*a* of the rotary shaft 6 in a scroll compressor according to Embodiment 2 of the present invention. In the drawing, (a) is an overall view, and (b) is a detailed view.

In the scroll compressor of Embodiment 1, the shape of the contact portion 6*f* is the hemispherical shape, that is, a "shape having a convex curved surface that contacts the inner wall surface of the slide hole 5*aa* of the slider portion 5*a* at one point." Meanwhile, in Embodiment 2, the shape of the contact portion 6*f* is a "shape extending in one direction and having a convex curved surface that contacts the inner wall surface of the slide hole 5*ea* of the slider portion 5*a* at one point." This shape is specifically a "shape having a convex curved surface formed by a locus obtained by moving a circular arc 21*a* along another circular arc 21*b* perpendicular to the circular arc 21*a*" (a partial surface shape forming the outer circumference of a toric surface).

The contact portion 6*f* is formed integrally with the eccentric shaft portion 6*a* at the position corresponding to the central portion in the axial direction of the orbiting bearing 2*d* similarly as in Embodiment 1. Further, as the shape of the contact portion 6*f* is changed to the "shape having a convex curved surface formed by a locus obtained by moving a circular arc 21*a* along another circular arc 21*b* perpendicular to the circular arc 21*a*," the shape of the elastic body 17 is changed from the shape illustrated in FIG. 3.

According to Embodiment 2, effects similar to those of Embodiment 1 are obtained, and the following effects are obtained by forming the contact portion 6*f* into the "shape having a convex curved surface formed by a locus obtained by moving a circular arc 21*a* along another circular arc 21*b* perpendicular to the circular arc 21*a*." That is, the contact portion can be processed while a cutter with a circular-arc shaped blade edge is moved along a circular arc in a direction perpendicular to the circular arc of the blade edge, and thus to process a vertex of the contact portion at high cutting speed. Consequently, a height dimension of a tip of the contact portion can highly accurately be processed, and thus the separation distance when the scrolls are not in contact with each other are precisely specified. Thus, the leakage loss can be further reduced when the scrolls are not in contact with each other.

The "shape extending in one direction and having a convex curved surface that contacts the inner wall surface of the slide hole 5*aa* of the slider portion 5*a* at one point" is not limited to the shape illustrated in FIG. 11, and may be modified to a shape illustrated in FIG. 12 described below, for example.

Figure 12:
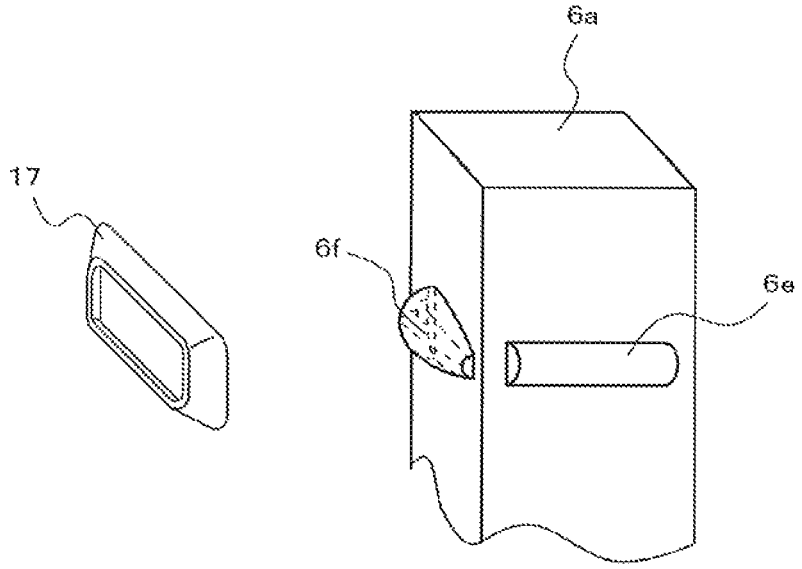
FIG. 12 includes perspective views of components in the vicinity of the eccentric shaft portion 6*a* of the rotary shaft 6 in a modified example of the scroll compressor according to Embodiment 2 of the present invention.
Figure 12:
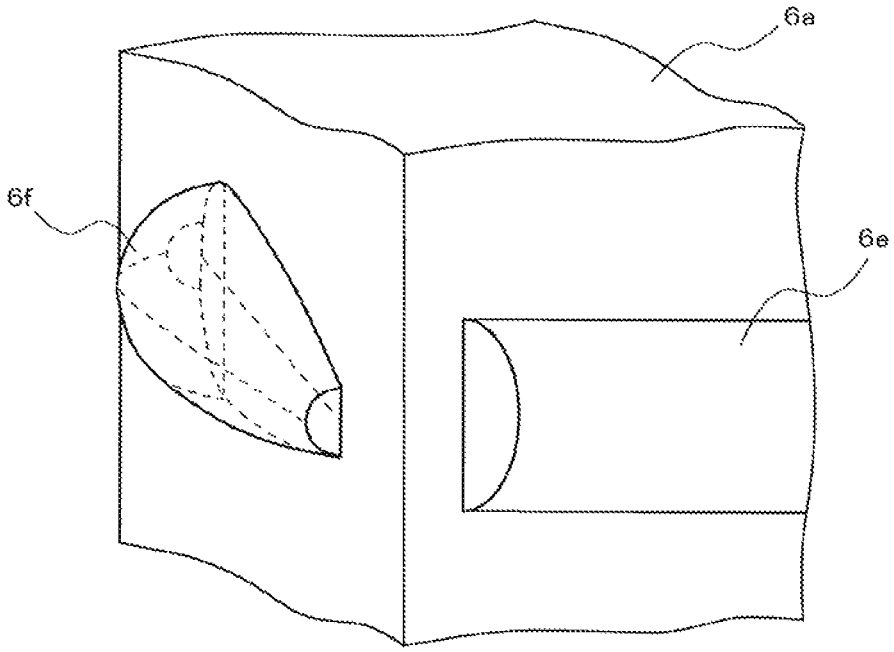

FIG. 12 includes perspective views of components in the vicinity of the eccentric shaft portion 6*a* of the rotary shaft 6 in a modified example of the scroll compressor according to Embodiment 2 of the present invention. In the drawing, (a) is an overall view, and (b) is a detailed view.

In this modified example, the contact portion 6*f* has an "elliptical, hemispherical shape having different curvatures on one curved surface." The contact portion 6*f* is formed integrally with the eccentric shaft portion 6*a* at the position corresponding to the central portion in the axial direction of the orbiting bearing 2*d* similarly as in Embodiment 1.

Effects similar to those of Embodiment 1 are also obtained in this modified example.

In short, the posture control unit is only required to be formed as follows, as in Embodiments 1 and 2 described above. That is, the posture control unit is only required to include, between the eccentric shaft portion 6*a* and the inner wall surface of the slide hole 5*aa* of the slider portion 5*a*, a convex curved surface that makes point contact at one point when the slider portion 5*a* is moved in the counter-eccentric direction by the centrifugal forces and other forces at or above the operating frequency No. That is, the convex curved surface is only required to be a curved surface that has one highest point (vertex) when the axis of the convex curved surface is set to the eccentric direction.

When the eccentric shaft portion 6*a* is inclined to the slider portion 5*a* by the centrifugal forces and other forces, the gap changes at the upper end and the lower end of the slide hole 5*aa*. When the height of a convex portion of the convex curved surface is set to be sufficiently higher than the difference in the change, point contact at one point on the convex curved surface is possible even when the eccentric shaft portion 6*a* is inclined.

The convex curved surface may preferably be a smooth three-dimensional convex curved surface other than the hemispherical surface, the toric surface, and the elliptical, hemispherical surface. With such a shape, when contact force between the contact portion 6*f* and a surface facing the contact portion 6*f* (that is, the inner wall surface of the slide hole 5*aa*) is increased, the convex curved surface is elastically deformed, and a minute area of point contact is increased, to reduce abrasion and damage of the contact portion 6*f* and extend the lifetime of the contact portion 6*f*. Although, for accuracy, the convex curved surface is desirable to be processed integrally with the eccentric shaft portion 6*a*, a component having the convex curved surface may be separately formed and integrally combined with the eccentric shaft portion 6*a*. The convex curved surface may be formed with a material and process (such as nitriding process) for making the hardness of the convex curved surface higher than that of the material of the eccentric shaft portion 6*a* to prevent abrasion, because such a material and process enables extension of the lifetime of the convex curved surface. Further, a surface faced and contacted by the vertex of the convex curved surface may also be processed similarly.

Further, although, for easier processing, the convex curved surface is formed on the eccentric direction-side side surface of the eccentric shaft portion 6*a* facing the inner wall surface of the slide hole 5*aa*, similar effects are also obtained when the convex curved surface is formed on the inner wall surface of the slide hole 5*aa*. In short, the contact portion 6*f* is required to be a convex portion of a curved surface having one vertex and provided to project toward one of the eccentric direction-side side surface of the eccentric shaft portion 6*a* and the inner wall surface of the slide hole 5*aa* facing the side surface.

Figure 13:
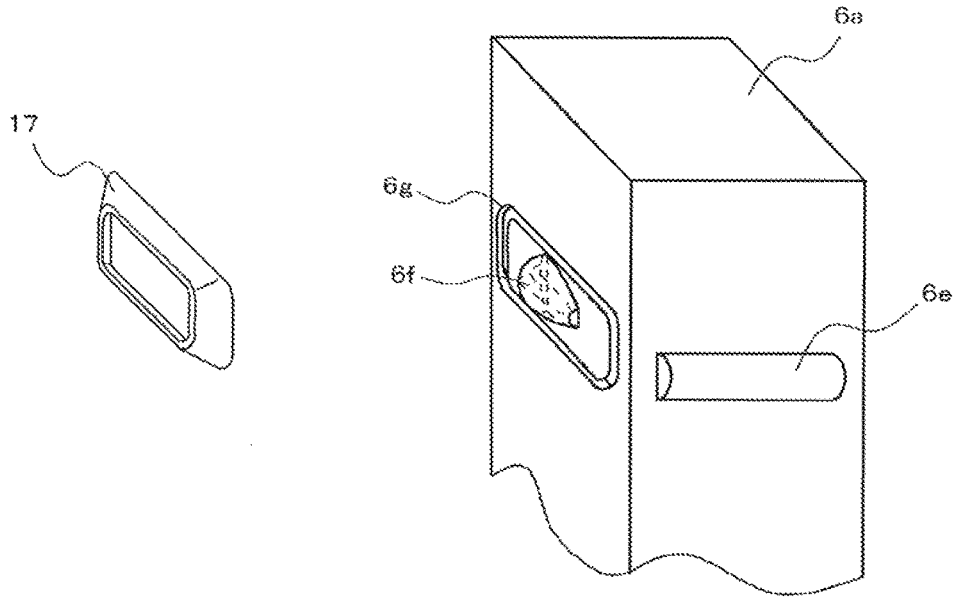
FIG. 13 is a perspective view of components in the vicinity of the eccentric shaft portion 6*a* of the rotary shaft 6 in another modified example of the scroll compressor according to Embodiment 2 of the present invention.

FIG. 13 is a perspective view of components in the vicinity of the eccentric shaft portion 6*a* of the rotary shaft 6 in another modified example of the scroll compressor according to Embodiment 2 of the present invention.

As illustrated in FIG. 13, a recess (ring-shaped groove) 6*g* for holding the elastic body 17 may be provided in the eccentric shaft portion 6*a*. With a part of the elastic body 17 inserted in the recess 6*g*, displacement of the elastic body 17 is preventable. The position at which the recess 6*g* is formed is not limited to the eccentric shaft portion 6*a*, and may be formed on the inner wall of the slide hole 5*aa*.

Thus, providing the recess 6*g* prevents malfunction resulting from contact between the contact portion 6*f* and the elastic body 17 at an unexpected position due to the displacement of the elastic body 17. Further, one end of the elastic body 17 may be fixed instead of inserting a part of the elastic body 17 in the recess 6*g*. The recess 6*g* is also applicable to the configuration formed with the contact portion 6*f* illustrated in FIG. 11.

Embodiment 3

Embodiment 3 is different from Embodiment 1 in the configuration of the elastic body for ensuring the initial startup performance, items not particularly described in Embodiment 3 are similar to those in Embodiment 1. The following description will focus on differences of Embodiment 3 from Embodiment 1.

Figure 14:
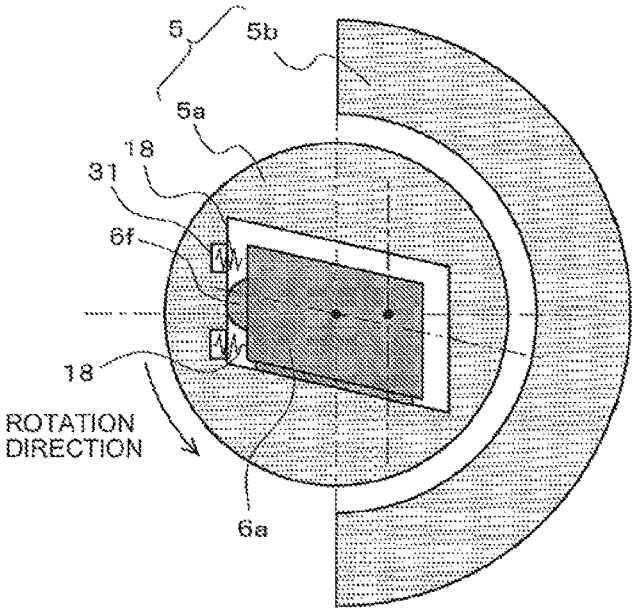
FIG. 14 is a cross-sectional view of components in the vicinity of the eccentric shaft portion 6*a* of the rotary shaft 6 in a scroll compressor according to Embodiment 3 of the present invention.

FIG. 14 is a cross-sectional view of components in the vicinity of the eccentric shaft portion 6*a* of the rotary shaft 6 in a scroll compressor according to Embodiment 3 of the present invention.

The scroll compressor of Embodiment 3 includes a plurality of coil springs 18 in place of the elastic body 17 formed of a disc spring in Embodiment 1. The plurality of coil springs 18 are provided to surround the circumference of the contact portion 6*f*, have an operation similar to that of the elastic body 17 of Embodiment 1, and ensure the initial startup performance. The coil springs 18 may be tension springs or compression springs.

According to Embodiment 3, effects similar to those of Embodiment 1 are obtainable. Further, in Embodiment 3, a recess 31 is formed around a portion of the inner wall surface of the slide hole 5*aa* that contacts the contact portion 6*f*. The recess 31 has operation and effects similar to those of the recess 6*g* of Embodiment 2 illustrated in FIG. 13. That is, parts of the coil springs 18 are inserted in the recess 31 to prevent displacement of the coil springs 18. The position at which the recess 31 is formed is not limited to the inner wall of the slide hole 5*aa*, and may be formed on the eccentric shaft portion 6*a*.

Embodiment 4

Embodiment 4 is different from Embodiment 1 in the configuration for ensuring the initial startup performance, and items not particularly described in Embodiment 4 are similar to those in Embodiment 1. The following description will focus on differences of Embodiment 4 from Embodiment 1.

Figure 15:
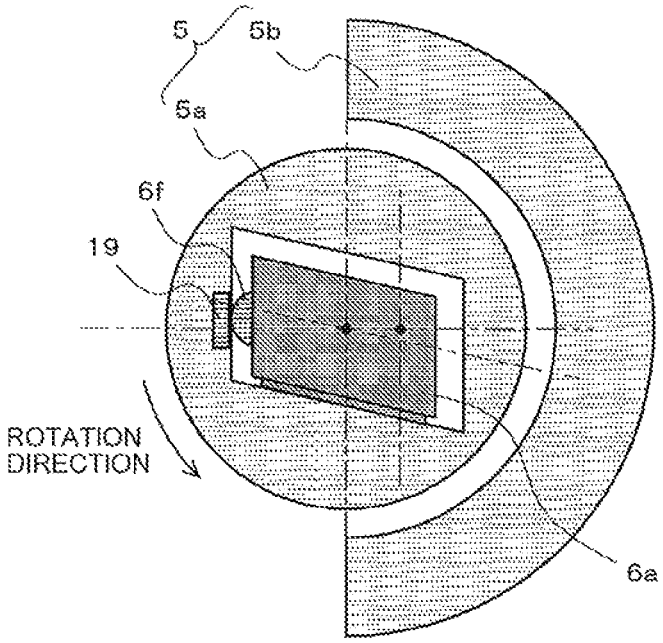
FIG. 15 is a cross-sectional view of components in the vicinity of the eccentric shaft portion 6*a* of the rotary shaft 6 in a scroll compressor according to Embodiment 4 of the present invention.

FIG. 15 is a cross-sectional view of components in the vicinity of the eccentric shaft portion 6*a* of the rotary shaft 6 in a scroll compressor according to Embodiment 4 of the present invention.

In Embodiment 1 described above, the elastic body 17 is used to ensure the initial startup performance. In Embodiment 4, on the other hand, a magnet 19 is provided in the slider portion 5*a*, and the entirety of the contact portion 6*f* or a part of the contact portion 6*f* facing the magnet 19 is formed of a magnet, to thereby ensure the initial startup performance. The magnet 19 and the magnet portion of the contact portion 6*f* form a magnetic force generating unit according to the present invention.

In the thus-configured scroll compressor, suction force between the magnet 19 and the contact portion 6*f* acts on the slider portion 5*a* instead of the elastic force Fs at startup (when the operation is stopped), enabling to ensure the initial startup performance.

According to Embodiment 4, effects similar to those of Embodiment 1 are obtained, and the following effect is obtained since the magnet 19 is provided in the slider portion 5*a* and the contact portion 6*f* is formed of a magnet. That is, this configuration ensures initial startup performance equivalent to that of Embodiment 1, without the elastic body 17 stored in the slide hole 5*aa* of the slider portion 5*a*.

Embodiment 5

Embodiment 5 relates to a reduction of the number of components, and items not particularly described in Embodiment 5 are similar to those in Embodiment 1. The following description will focus on differences of Embodiment 5 from Embodiment 1.

Figure 16:
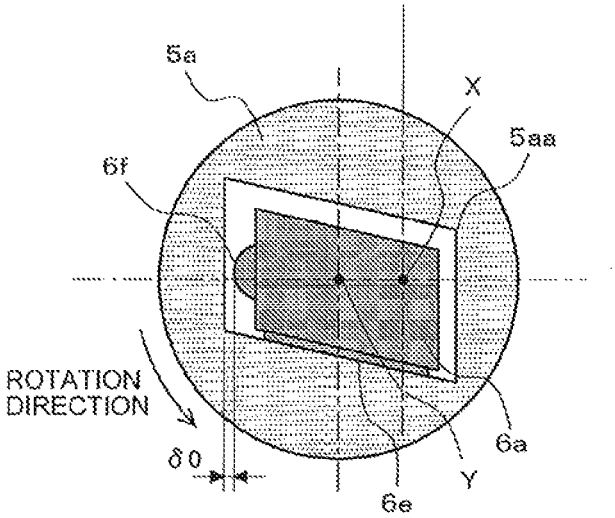
FIG. 16 is a cross-sectional view of components in the vicinity of the eccentric shaft portion 6*a* of the rotary shaft 6 in a scroll compressor according to Embodiment 5 of the present invention.

FIG. 16 is a cross-sectional view of components in the vicinity of the eccentric shaft portion 6*a* of the rotary shaft 6 in a scroll compressor according to Embodiment 5 of the present invention.

While Embodiment 1 described above uses the elastic body 17, Embodiment 5 is configured not to use the elastic body 17. The initial gap 50*a* allowing the separation distance is specified as the predetermined distance 80 similarly as in Embodiment 1, to thereby control the gap between the scroll body side surfaces when the two scroll bodies 1*b* and 2*b* are separated from each other, and minimize the leakage occurring in the gap when the scroll bodies 1*b* and 2*b* are separated from each other.

In Embodiment 5, the elastic body 17 is not used, and thus the elastic force Fs is zero. As compared with Embodiment 1, consequently, the pressing load Fw acting on the balance weight-equipped slider 5 in Embodiment 5 is rendered as a graph obtained by lowering the graph of the solid line in FIG. 6, and the pressing load Fw is zero at or above the operating frequency N*, which corresponds to an intersection point of the graph and a load of zero. That is, when the elastic body 17 is not used, the scroll bodies 1*b* and 2*b* separate from each other at an operating frequency lower than that in the case where the elastic body 17 is used.

As described above, because the initial gap 50*a* is specified to be minimum, the leakage in the gap can be minimized even when the scroll bodies 1*b* and 2*b* separate from each other at a low operating frequency, and thus the pressure in the compression chamber 3 increases sufficiently. Further, the scroll bodies 1*b* and 2*b* can be pressed against each other from the startup time with the component force Fn·sine of the reaction force (drive transmitting reaction force) Fn against the pressure of the working gas.

According to Embodiment 5, effects similar to those of Embodiment 1 are obtained, as described above. Further, Embodiment 5 does not use the elastic body, and thus is capable of reducing the number of components and cost as compared with Embodiment 1. Embodiment 5 is also capable of ensuring initial startup performance equivalent to that of Embodiment 1, without the elastic body 17 stored inside the slider portion 5*a*.

Although Embodiments 1 to 5 have been described as separate embodiments, respective characteristic configurations of Embodiments 1 to 5 may be combined as appropriate to configure a scroll compressor. Further, any modified example of each of Embodiments 1 to 5 applicable to similar configuration parts is similarly applicable to the other ones of Embodiments 1 to 5 than the one of Embodiments 1 to 5 in which the modified example has been described.

REFERENCE SIGNS LIST

1 fixed scroll 1*a* baseplate 1*b* scroll body 2 orbiting scroll 2*a* baseplate 2*b* scroll body 2*c* boss 2*d* orbiting bearing 3 compression chamber 4 baffle 4*a* discharge port 5 balance weight-equipped slider 5*a* slider portion 5*aa* slide hole 5*b* balance weight portion 6 rotary shaft 6*a* eccentric shaft portion 6*b* main shaft portion 6*c* sub-shaft portion 6*e* contact portion 6*f* contact portion 6*g* recess 7 frame 7*a* thrust surface 7*b* main bearing 7*c* communication flow path 8 sub-frame plate 9 sub-frame 10 electric motor 10*a* electric motor stator 10*h* electric motor rotator 11 discharge valve 12 discharge muffler container 13 sleeve 14 sub-bearing 17 elastic body 18 coil spring 19 magnet 20 discharge port 21*a* circular arc (first circular arc) 21*b* circular arc (second circular arc) 30 central axis of eccentric shaft portion 31 recess 50*a* initial gap 60 first balance weight 61 second balance weight 70 lower space 71 intermediate space 72 upper space 100 airtight container 101 suction pipe 102 discharge pipe 112 pump element.

The invention claimed is:

1. A scroll compressor comprising:

a fixed scroll provided in a container;

an orbiting scroll configured to orbit relative to the fixed scroll;

a rotary shaft configured to transmit rotational drive force to the orbiting scroll;

an eccentric shaft portion provided on one end side of the rotary shaft to be eccentric to the rotary shaft;

a balance weight-equipped slider integrated of a slider portion having a slide hole and a balance weight portion, in a plane perpendicular to an axis of the rotary shaft, movable along the slide hole relative to the eccentric shaft portion inserted in the slide hole, and having centrifugal force set to be greater than centrifugal force of the orbiting scroll;

an orbiting bearing provided to the orbiting scroll and rotatably supporting the slider portion of the balance weight-equipped slider; and a convex portion having a curved surface with one vertex, provided to one of an eccentric direction-side side surface of the eccentric shaft portion and an inner wall surface of the slide hole facing the side surface, configured to act as a posture control unit, the one vertex is located at a position corresponding to a central portion in an axial direction of the orbiting bearing between the eccentric direction-side side surface of the eccentric shaft portion and the inner wall surface of the slide hole facing the side surface, and configured to control a posture of the balance weight-equipped slider so that the slider portion of the balance weight-equipped slider maintains the posture parallel to the orbiting bearing, wherein the convex portion is configured to make point contact at one point when the slider portion is moved in a counter-eccentric direction.

2. The scroll compressor of claim 1, wherein the convex portion has a hemispherical shape.

3. The scroll compressor of claim 1, wherein the convex portion has a shape with a convex curved surface formed by a locus obtained by moving a first circular arc along a second circular arc perpendicular to the first circular arc.

4. The scroll compressor of claim 1, wherein the convex portion has an elliptical, hemispherical shape having different curvatures on one curved surface.

5. The scroll compressor of claim 1, further comprising an elastic body configured to bias the slider portion toward an eccentric direction to press the orbiting scroll toward the eccentric direction.

6. The scroll compressor of claim 5, wherein the elastic body comprises a disc spring.

7. The scroll compressor of claim 5, wherein the elastic body comprises a coil spring.

8. The scroll compressor of claim 5, wherein one of the eccentric direction-side side surface of the eccentric shaft portion and the inner wall surface of the slide hole facing the side surface has a recess configured to store a part of the elastic body.

9. The scroll compressor of claim 1, further comprising a magnetic force generating unit configured to generate magnetic force for causing the eccentric direction-side side surface of the eccentric shaft portion and the inner wall surface of the slide hole facing the side surface to magnetically attract each other.

* * * * *